United States Patent [19]

Rogers, Jr.

[11] 4,071,275

[45] Jan. 31, 1978

[54] RECLINER CHAIR WITH WALL AVOIDING ACTION

[75] Inventor: Walter Clark Rogers, Jr., Denton, N.C.

[73] Assignee: Royal Development Company, Inc., High Point, N.C.

[21] Appl. No.: 669,270

[22] Filed: Mar. 22, 1976

[51] Int. Cl.[2] ..... A47C 1/02

[52] U.S. Cl. ..... 297/85; 297/86; 297/322

[58] Field of Search ..... 297/83–87, 297/317, 320–322, 341, 342, 69, 271, DIG. 7

[56] References Cited

U.S. PATENT DOCUMENTS

| | | | |
|---|---|---|---|
| Re. 28,210 | 10/1974 | Ré | 297/83 |
| 3,337,267 | 8/1967 | Rogers, Jr. | 297/342 X |
| 3,550,952 | 12/1970 | Ferguson | 297/85 |
| 3,622,198 | 11/1971 | Ré | 297/84 |
| 3,743,349 | 7/1973 | Crum et al. | 297/317 X |
| 3,768,859 | 10/1973 | Rogers, Jr. et al. | 297/85 |
| 3,941,417 | 3/1976 | Ré | 297/85 |

*Primary Examiner*—Roy D. Frazier
*Assistant Examiner*—William E. Lyddane
*Attorney, Agent, or Firm*—William E. Mouzavires

[57] ABSTRACT

Linkage operated recliner chair having a TV position wherein a footrest is projected forwardly by a control handle while the seat and backrest undergoes slight reclining movement relative to a fixed base. However, due to linkage connected between the footrest linkage and the seal linkage, the seat and backrest which is pivotally mounted to the seat, also undergo forward translatory motion during movement of the footrest to extended position. Thus, while the seat and backrest undergo rearward and downward reclining movement, the backrest will not engage an adjacent wall due to the translatory movement. Such action in the trade is known as wall avoiding.

Further, and more pronounced, wall avoiding action is achieved by the chair of the present invention when moving to further reclining positions beyond the TV position. These positions are obtained by the occupant exerting back pressure on the backrest which, while causing the backrest to pivot in a rearward direction relative to the seat to increase the angle therebetween, also causes the actuation of two closed linkages to project the seat forwardly and consequently the backrest connected to it with compounded wall avoiding action.

To return the chair to normal or upright position with the footrest retracted, the occupant removes back pressure from the backrest which causes the chair and seat to return to TV position after which the control handle is operated to retract the footrest and move the backrest and seat to normal or upright position.

29 Claims, 9 Drawing Figures

RECLINER CHAIR WITH WALL AVOIDING ACTION

DEFINITIONS

It is believed that the following definitions of certain terms will facilitate better understanding of the present invention.

| Terms | Definition |
|---|---|
| Wall-avoiding or Wallaway Recliner or Wall-avoiding Chair | A type of recliner chair or linkage action for a recliner chair wherein when moving to a reclining position, the backrest also moves forwardly so that if placed adjacent a wall, the backrest will not strike the wall. |
| Two-way Recliner or Two-way Recliner Chair | A recliner chair whose seat and backrest are rigidly fixed to each other to always move together. |
| Three-way Recliner or Three-way Recliner Chair | A recliner chair whose backrest may move into reclining positions relative to the seat which also is capable of moving into reclining positions relative to a fixed base, the angle between the backrest and seat being variable in different reclining positions. |
| Up-right or Normal Position of a Recliner Chair | The position in a recliner chair such as normally exists when the chair is unoccupied, with the backrest in the most upright position and with the footrest retracted. |
| Full Recline or Fully Reclined Position of a Recliner Chair | The position of a recliner chair when its backrest has been fully reclined to the ultimate angle relative to the horizontal. |
| TV Position of a Recliner Chair | A predetermined position in a recliner chair where the footrest is projected forwardly from the chair with the backrest in upright or normal position or in substantially upright or normal position. |
| Handle-operated Recliner | A recliner chair having a footrest operated by a manual control handle usually mounted on one side of the chair to be easily grasped by the occupant. |

BACKGROUND OF INVENTION

Traditionally, recliner chairs have been specialty furniture items which were primarily designed for comfort, not styling. In many cases, they occupied a special status in the home as they did not conform to the existing styling of other furniture items in the home. However, the evolution of styling of home interiors has progressed to the point where today it is of major concern. Thus, in many instances, the recliner chair can no longer enjoy special status free of present day styling requirements which not only dictate, in many cases, low styling with T-seat cushions, but also that the chairs be capable of placement adjacent a wall like any other upholstered chair. The latter desideratum has given rise to what is known in the industry today as the wall-avoiding chair which is a recliner chair that can be placed adjacent a wall and yet its backrest will not strike the wall when the chair is moved to reclining position.

Most wall-avoiding chairs of the past and present have utilized tracks on which the chair arms are slidable forwardly in order to provide wall-avoiding action. However, such tracks require precision construction and assembly to prevent jamming of parts in the tracks and malfunctioning of the wall-avoiding action which has been known to occur after repeated but normal usage of the chair.

In addition, such conventional wall-avoiding chairs utilizing tracks suffer from the styling drawback that the seat must be separated from the arms of the chair to permit the movement of the arms in the tracks. This impairs the use of T-cushion seat styling which has now become quite desirable for recliner chairs. Further, many of these wall-avoiding chairs were only two-way recliners providing only limited types of reclining comfort as compared to that achieved by three-way recliners.

While, in the past, there was an attempt at marketing a three-way wall-avoiding chair which provided wall-avoiding action without the need of tracks as described above, such a chair did not have a TV position; which position is now virtually a standard requirement, if not a highly desirable feature of recliner chairs.

OBJECTS OF THE PRESENT INVENTION

It is an object of the present invention to provide a novel and improved wall-avoiding chair free of the aforementioned drawbacks of prior art chairs and which may be designed to meet present day styling requirements. Included herein is a three-way wall-avoiding recliner chair having a TV position which may be obtained through the use of a manual control handle.

A further object of the present invention is a wall-avoiding chair providing improved wall-avoiding action through a balanced linkage system which is not dependent upon tracks heretofore utilized in conventional chairs but which is utilized to provide improved three-way reclining comfort over a number of positions between TV and fully reclined positions depending on the weight distribution of the occupant.

A further object of the present invention is to provide such a wall-avoiding chair that may be designed with low styling and T-seat cushions in accordance with present day styling requirements or tastes.

A further object of the present invention is to provide novel and improved linkage systems that may be utilized in wall-avoiding or other recliner chairs to provide improved action suitable for commercial production and retail for home use where they will dependably operate over long periods of repeated use without breakdown.

Another object of the present invention is to provide a novel mounting mechanism for wall-avoiding or other reclining chairs to prevent side sway of the seat and backrest.

DRAWINGS

DETAILED DESCRIPTION

BASIC CHAIR PARTS AND OPERATION

Figure 1A:
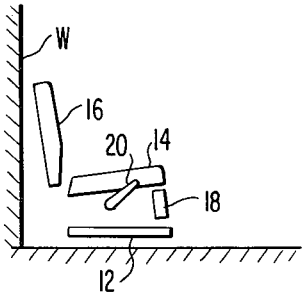
FIGS. 1A, 1B and 1C are diagrammatic views illustrating upright TV and fully reclined positions respectively of a wall-avoiding chair embodying the present invention.
Figure 1B:
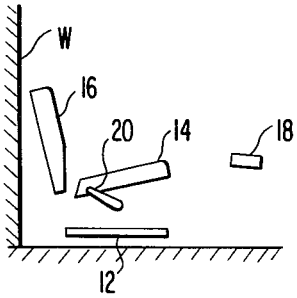
Figure 1C:
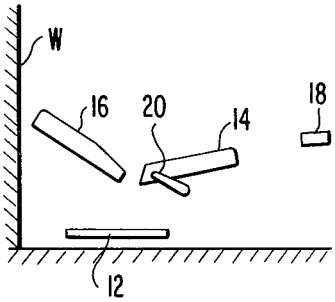

Referring to the drawings in detail there is shown for illustrative purposes only, a three-way wall-avoiding recliner chair generally designated 10 embodying the present invention and capable of movement between a normal or upright position shown in FIG. 1A; a TV position shown in FIG. 1B; a full recline position shown in FIG. 1C; and any number of balanced positions (not shown) between TV position and full recline. Chair 10 includes a base generally designated 12; a seat generally designated 14 mounted on base 12 for movement relative thereto; a backrest generally designated 16 pivotally mounted for movement relative to the seat; a footrest generally designated 18 mounted for movement between a retracted position (FIG. 1A) and an extended position (FIGS. 1B and 1C); and a handle 20 at one side of the chair for operating the footrest 18.

As shown in FIG. 1A, the chair in the upright or normal position has backrest 16 in generally upright position with the footrest 18 in retracted position where it extends vertically downward at the front of the seat 14. A nearby wall W is also shown to illustrate wall-avoiding action upon reclining of the chair. In FIG. 1B, handle 20 has been pivoted to move the footrest 18 into projected position. This is the TV position wherein the backrest 16 has been reclined only a slight amount (hardly noticeable from FIG. 1A) and is therefore in substantially upright position. Also, in TV position, the seat 14 and backrest 16 have been moved forwardly with wall-avoiding action; and the seat 14 has tilted in a counterclockwise direction from the position of FIG. 1A to the position of FIG. 1B.

In the position shown in FIG. 1C, the chair has been moved to full recline position with pronounced wall-avoiding action which has moved the backrest 16 and seat 14 forwardly relative to base 12 to prevent striking of the backrest against wall W. This position is achieved by the occupant exerting back pressure on backrest 16 which, because of the linkage system to be described below, causes the backrest 16 to incline rearwardly pivoting relative to the seat 14 while at the same time moving forward with the seat with wall-avoiding action.

Because of the balanced nature of the linkage system, the backrest may be reclined to, and held by the occupant's weight distribution in, any number of positions intermediate the TV position of FIG. 1B and the full recline position of FIG. 1C.

To return to the upright position of FIG. 1A from the full recline position of FIG. 1C, the occupant may either retract the footrest 18 using the control handle 20, which causes the linkage to overcome the occupant's weight on the seat and backrest to move the linkage system to bring the seat and backrest into the upright position; or the occupant may merely remove pressure from the backrest 16 which will cause the backrest and seat to return to the TV position (because of the redistribution of the occupant's weight) wherein the footrest may then be actuated by the handle 20 to return the chair to the upright position. In the specific embodiment shown, the footrest 18 may also be returned to retracted position by pressure exerted by the occupant's legs on the footrest; however, the preferred method is through use of the control handle 20.

THE SEAT AND ARMREST FRAMES

Figure 2:
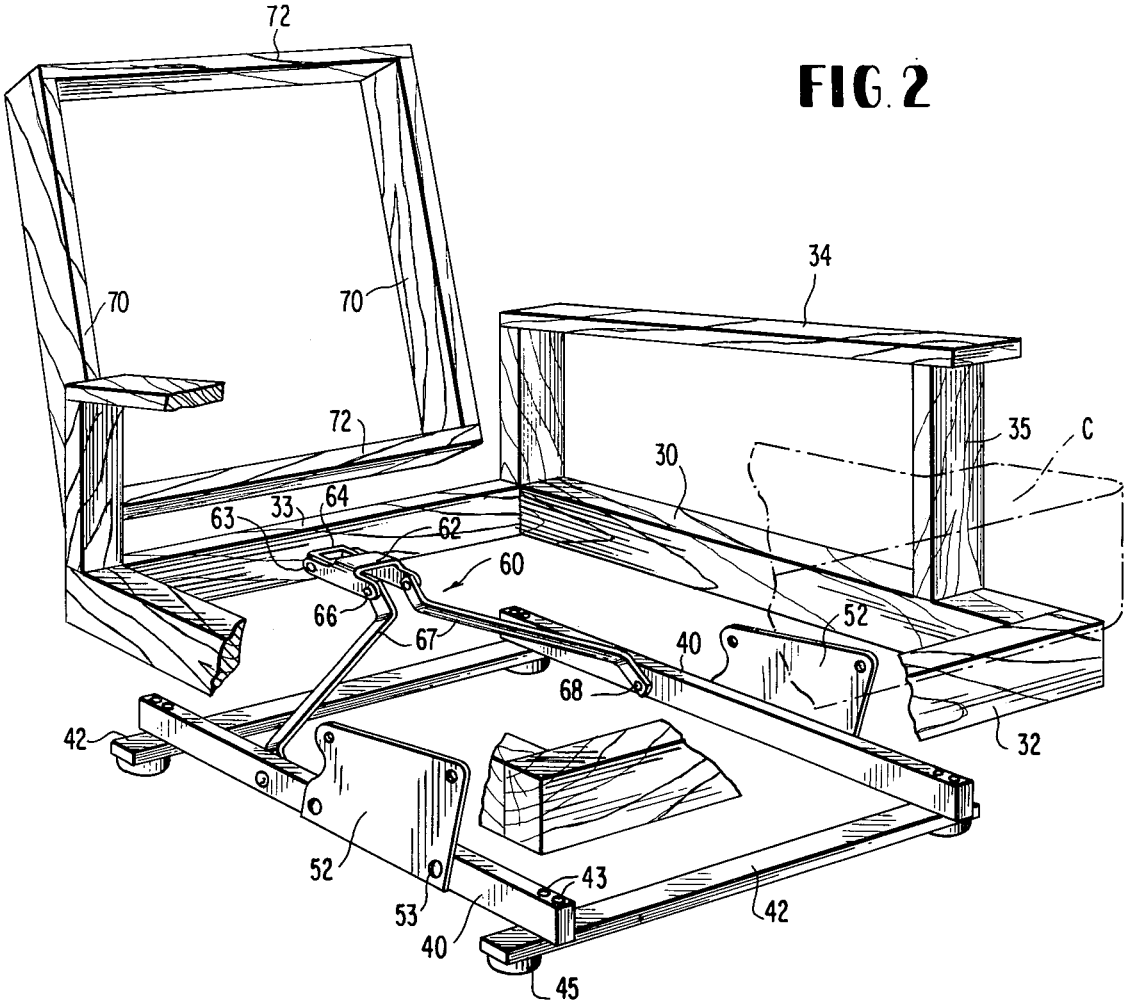
FIG. 2 is a perspective view of the base and frame structure of the wall-avoiding chair omitting certain linkage mechanisms and the footrest but showing, in phantom lines, a portion of a T-seat cushion included in the chair.

Referring now to FIG. 2, the seat 14 and backrest 16 may have any suitable frame structure shown as made from wood pieces on which is attached suitable upholstery, not shown, in conventional manner. Thus, the frame of seat 14 includes opposite parallel side pieces 30 interconnected by front and rear end pieces 32, 33 to form a generally rectangular structure. The arms of the chair similarly may have wood frame pieces 34, 35 fixed to seat frame 30 to be moved with it when the chair is reclined. In contrast to prior wall-avoiding chairs utilizing track systems, the present invention permits the chair arms 34 to be fixed to the seat so that they form a single unit with the seat. This permits a T-seat cushion to be utilized and in the specific embodiment, the front frame pieces 35 of the chair arms are recessed rearwardly from the front frame piece 32 to accommodate the front C of the T-seat cushion which extends fully across the front frame piece 32 of the seat.

THE BASE FRAME

The base 12 of the chair may be formed conventionally from wood pieces; however, in the preferred form of the invention, base 12 is formed from elongated metallic members 40 and 42 secured together such as by fasteners 43. Preferably, base members 42 which are the front and rear members of the base are formed by steel bars or tubes while side members 40 are formed by rectangular tubular members. Nylon bearing 45 or any other low friction members may be fixed to the corners of the base as shown in FIG. 2.

Seat 14 which includes seat frame members 30, 32, 33 is mounted to the base by means of two identical linkage systems on each side of the chair to be described in detail below. Each linkage system includes a seat mounting link 50 which may be termed a "seat link" formed by an elongated steel bar of generally L-shaped cross section rigidly secured such as by screws to one of the side frame side pieces 30 of the seat 14. Each linkage system is mounted to the base 12 by means of a vertical mounting plate 52 preferably a steel plate, fixed by screws 53 to an associated side member 40 of the base and projecting upwardly therefrom at intermediate locations on the base members 40.

STABILIZING LINKAGE

Referring to FIG. 2, in order to stabilize the seat 14 and backrest 16 against side-by-side movement or "sway" when they are in normal or upright position or moving to or from reclining positions, a stabilizing linkage generally designated 60 is provided between the base 12 and seat 14. Stabilizing linkage 60 includes a link in the form of a yoke 62 having arms pivoted at one end by pins 63 relative to the rear end frame piece 33 of the seat 14 by means of a bracket 64 shown as being U-shaped. Bracket 64 is rigidly fixed by screws (not shown) to the rear end frame piece 33 at its center. The opposite ends of the arms of yoke 62 are pivotally connected by pins 66 to stabilizing links 67 which, in turn, are pivotally mounted by pins 68 to the side frame members 40 of base 12 at a location rearwardly of vertical mounting plates 52.

As shown in FIG. 2, stabilizing links 67 and yoke 62 are movable relative to the base 12 when the chair is moved to its various positions, to provide stabilization preventing sway or side-by-side movement by the seat and backrest. This support is in addition to that provided by the linkage system on opposite sides of the chair which also serve to mount the seat to the base as will be described.

BACKREST FRAME

As shown in FIG. 2, backrest 16 may include any conventional frame such as wood side pieces 70 interconnected by upper and lower end pieces 72. Backrest 16 is mounted for reclining movement relative to the seat 14 by means of backrest mounting links 74 respectively fixed to the side pieces 70 of the backrest frame.

SEAT LINKAGE SYSTEM

The linkage systems for operating the various parts of the chair will now be described. Since there are two identical linkage systems on each side of the chair only one need be described.

With reference to FIGS. 4 through 7, seat 14 is mounted to the base and specifically vertical mounting plates 52 by a seat linkage system which includes two closed linkages. One closed linkage each comprised of links pivotally interconnected in series to form a closed linkage; hence the terminology "closed linkage", hereinafter referred to at times as the "first seat linkage", includes the seat link 50 which as described above is fixed rigidly to the side piece 30 of the seat frame. Further included are a front mounting link 80, a rear mounting link 82 and a long link 84 which may be termed a "carrier link" extending in the forward-rearward direction of the chair with its opposite ends pivotally connected to front and rear mounting links 80 and 82 by pins 85 and 86 respectively. The upper end of front mounting link 80 is pivotally mounted by pin 87 to a forward portion of seat link 50; while the upper end of rear mounting link 82 is pivotally connected by pin 88 to an inverted V-shaped link 90 which is used to mount the backrest 16 relative to the seat.

The aforedescribed closed seat linkage, comprised of seat link 50, carrier link 84 and front and rear mounting links 80 and 82, are mounted by another closed linkage to the base 12 to provide compound wall-avoiding action. This other closed linkage, hereinafter referred to at times as the "second seat linkage", is a four-bar linkage including the base 12 and specifically the vertical mounting plate 52 fixed to and upstanding from the base side frame member 40; front and rear mounting links 100 and 102 having their upper end pivotally mounted to the vertical mounting plate 52 by pins 104 and 106 respectively; and carrier link 84 to which the lower ends of mounting links 100 and 102 are pivoted by pins 108 and 110. It will be seen that the mounting links 100 and 102 included in the second seat linkage, serve to ultimately mount the seat to the base 12. Also, mounting links 100 and 102 serve to swing the first seat linkage forwardly from the TV position shown in FIG. 6 and in dotted lines in FIG. 7 to the various advanced reclining positions including the fully reclined position shown in FIG. 7, to provide wall-avoiding action. In achieving the latter, the front mounting link 100 of the second seat linkage is actuated by a link 112 which may be termed an "actuator link". This actuator link 112 has its lower end pivotally connected by pin 114 to a crank portion 101 formed on the lower extremity of front mounting link 100. In the specific embodiment shown, the upper end of actuator link 112 is pivotally connected by pin 116 to seat link 50 so that as the first seat linkage (50, 80, 82, 84) is expanded (by linkage means to be described below) through its positions to full recline position shown in FIG. 7, the actuator link 112 will exert a downward force in the counterclockwise direction as viewed in FIGS. 6 and 7 to swing front mounting link 100 of the second seat linkage forwardly about pivot pin 104 to project the first seat linkage which includes the seat 14 forwardly to enhance or compound the wall-avoiding action. Although not shown, the preferred method of connecting actuating link 112 to the first seat linkage is to connect it to the rear mounting link 82 at a point above pivot 86. This improves the leverage, i.e., the distance between pivot 108 and the line of thrust along which link 112 exerts its force on link 101 in the extreme position of travel of link 100.

BACKREST LINKAGE

As described above, backrest frame 70, 72 has a link 74 fixed to its side piece 70. Link 74 has a crank 75 projecting generally forward from its lower end, and pivoted at the bend or bite of crank portion 75 is the inverted V-shaped backrest mounting link 90 whose bite or vertex portion is pivoted by pin 91 to the backrest link 74 at the bend of crank 75. As described above, one leg of backrest mounting link 90 is pivoted by pin 88 to rear mounting link 82 of the first seat linkage. The other leg of backrest mounting link 90 is pivoted by pin 92 to the rear end of seat link 50.

Figure 6:
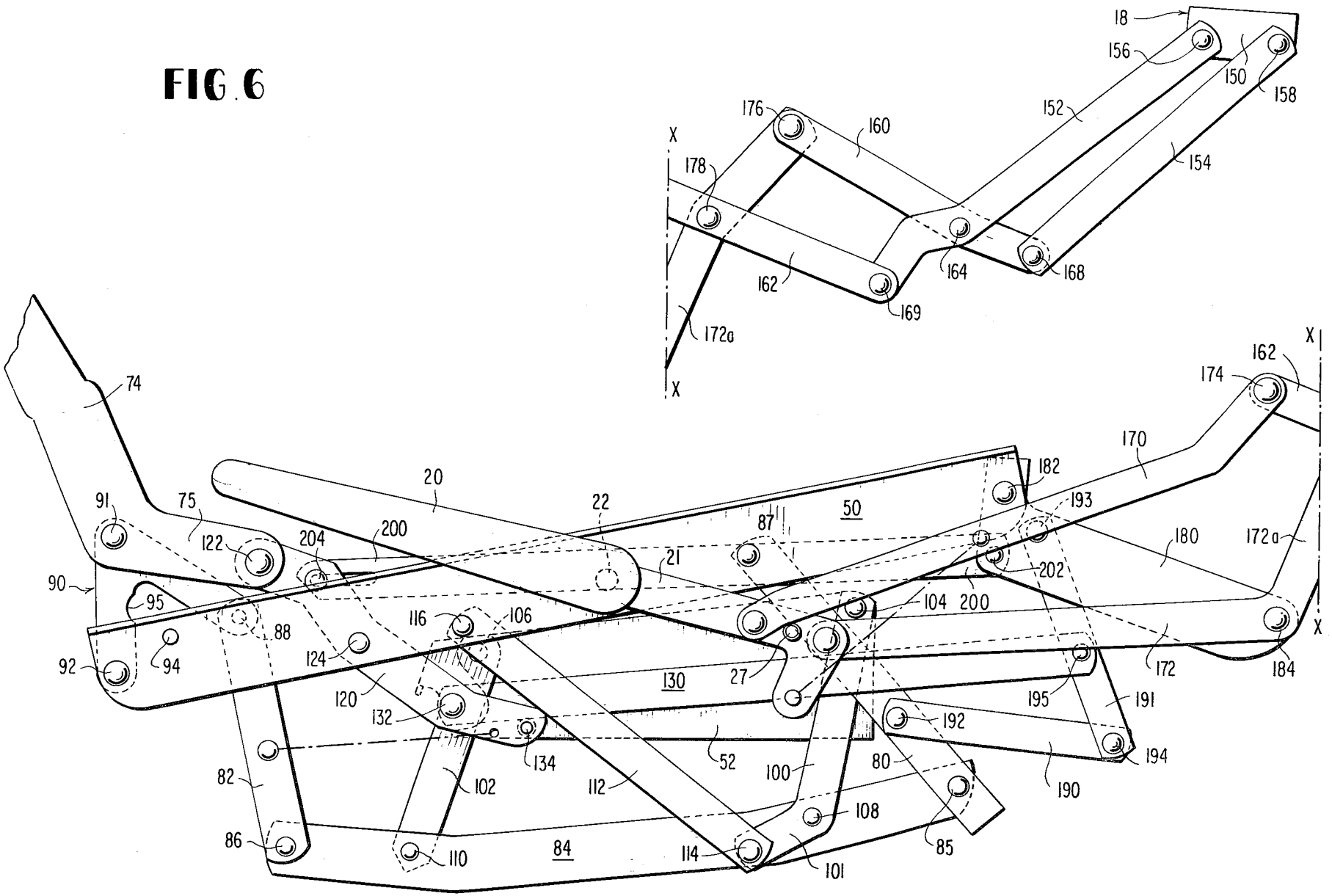
FIG. 6 is a view similar to FIG. 5 but with the chair in TV position, that is, with the footrest fully extended.
Figure 7:
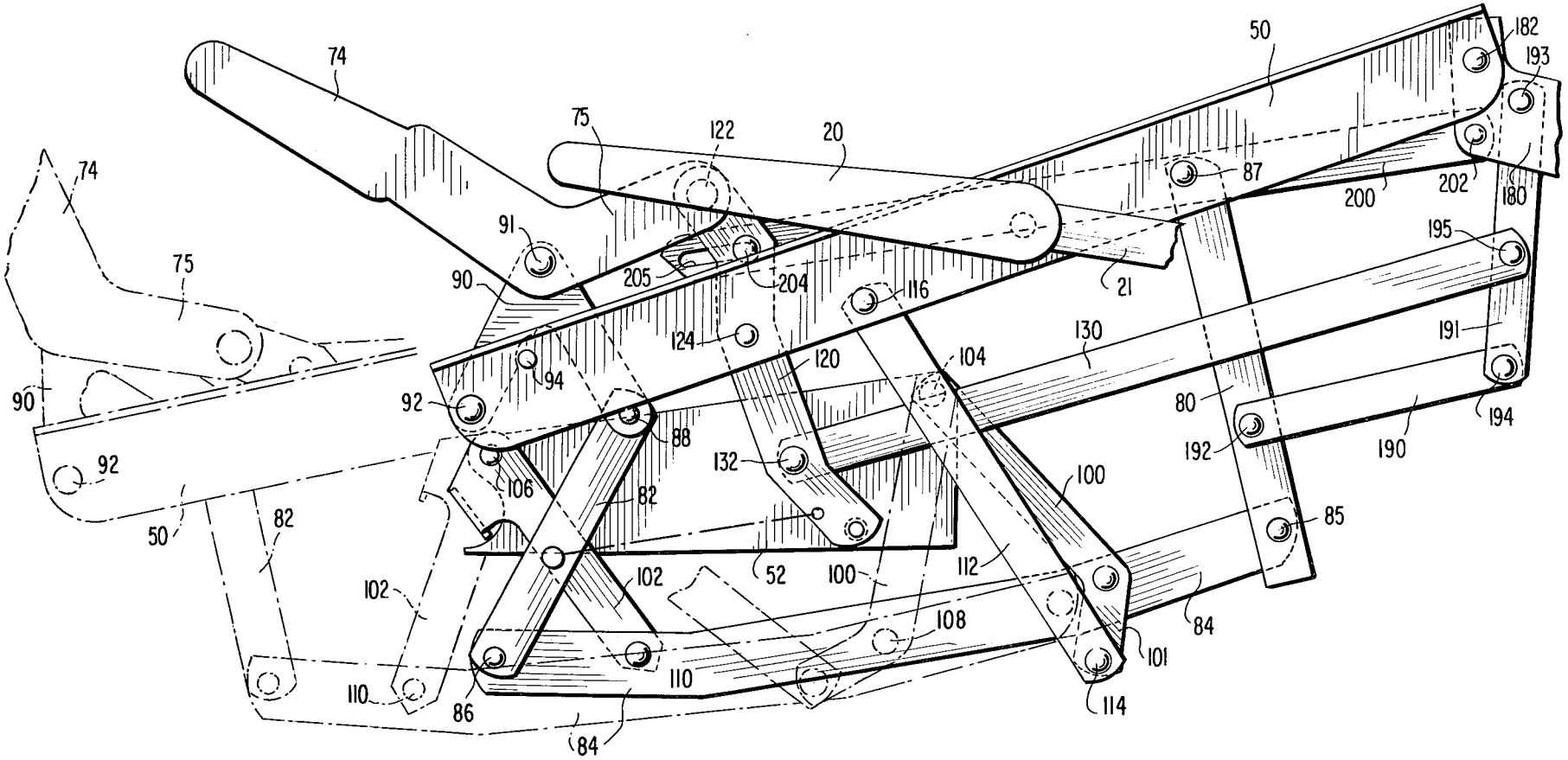
FIG. 7 is a view similar to FIG. 6 but with the chair in fully reclined position, and including dotted lines to show the position of certain parts when in the TV position.

When moving into advanced reclining positions from the TV position shown in FIG. 6, to the fully reclined position of FIG. 7, the backrest pivots about pivot pin 91 relative to backrest mounting link 90 while also pivoting in a path about pin 92 because backrest mounting link 90 is pivoting about pin 92 in a clockwise direction as viewed in FIGS. 6 and 7, relative to seat link 50. This perhaps is best illustrated in FIG. 7 where the dotted line portion of the parts represents the TV position and the solid line portion of the parts represents the advanced or full recline position. This full recline position is limited and defined by stop pin 94 fixed to seat link 50 so as to engage the rear leg of backrest mounting link 90 when the backrest arrives at the full recline position. Backrest mounting link 90 is provided with a recess 95 in its rear leg for receiving stop pin 94.

In order to actuate the first seat linkage when the backrest is moved into reclining positions beyond TV position to provide wall-avoiding action, the lower crank portion 75 of backrest link 74 is pivotally connected to an actuator link 120 by pivot 122. Actuator link 120 is pivoted intermediate its ends by a pin 124 to the seat link 50 so as to be pivotable relative to the seat link 50 when the backrest moves into reclining positions beyond TV position or towards TV position from full recline position. As will be described further below, actuator link 120 has its lower end portion pivotally connected to an elongated transmission link 130 by pin 132 for transmitting motion from actuator link 120 to open the first seat linkage for projecting the seat forwardly to provide wall-avoiding action when the backrest is reclined beyond the TV position such as illustrated in FIG. 7. Actuator link 120 is provided with a stop 134 engageable with transmission link 130 to prevent pivotal movement of actuator link 120 about pivot 124 in a counterclockwise direction (as viewed in FIG. 6) which would otherwise cause undesirable forward pivotal movement of the backrest in upright and TV position. Stop 134 has other purposes to be described below. Although stop 134 is shown slightly spaced from link 130 in the upright position of the chair, it should be understood that stop 134 immediately engages link 130 upon initial movement of the footrest to TV position. If desired, the linkage could be designed so that stop 134 would engage link 130 when the chair is in the upright position.

FOOTREST LINKAGE

Figure 3:
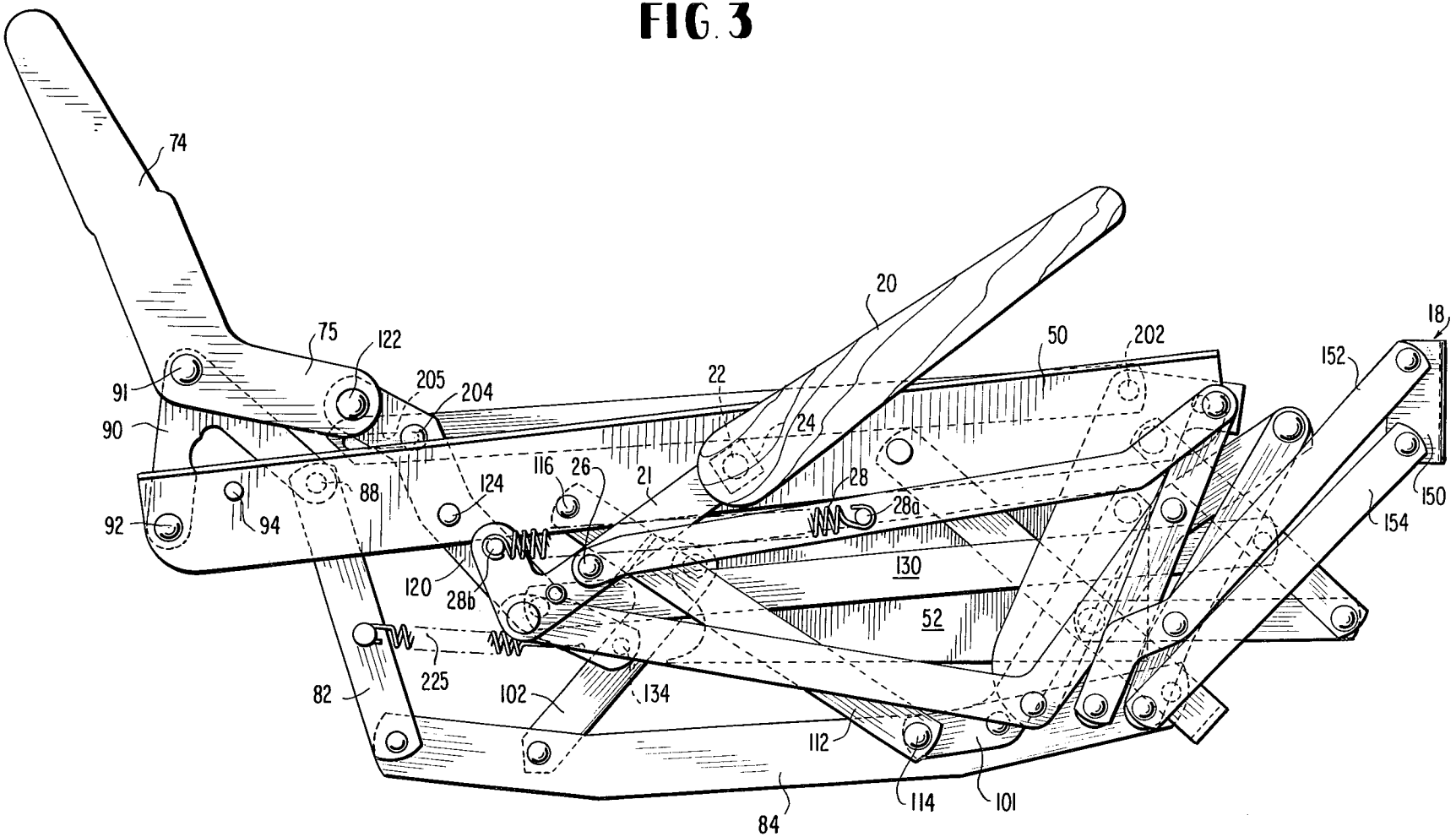
FIG. 3 is a side view of a linkage system included at one side of the chair as seen from the outside of the chair when the chair is in normal or upright position.
Figure 4:
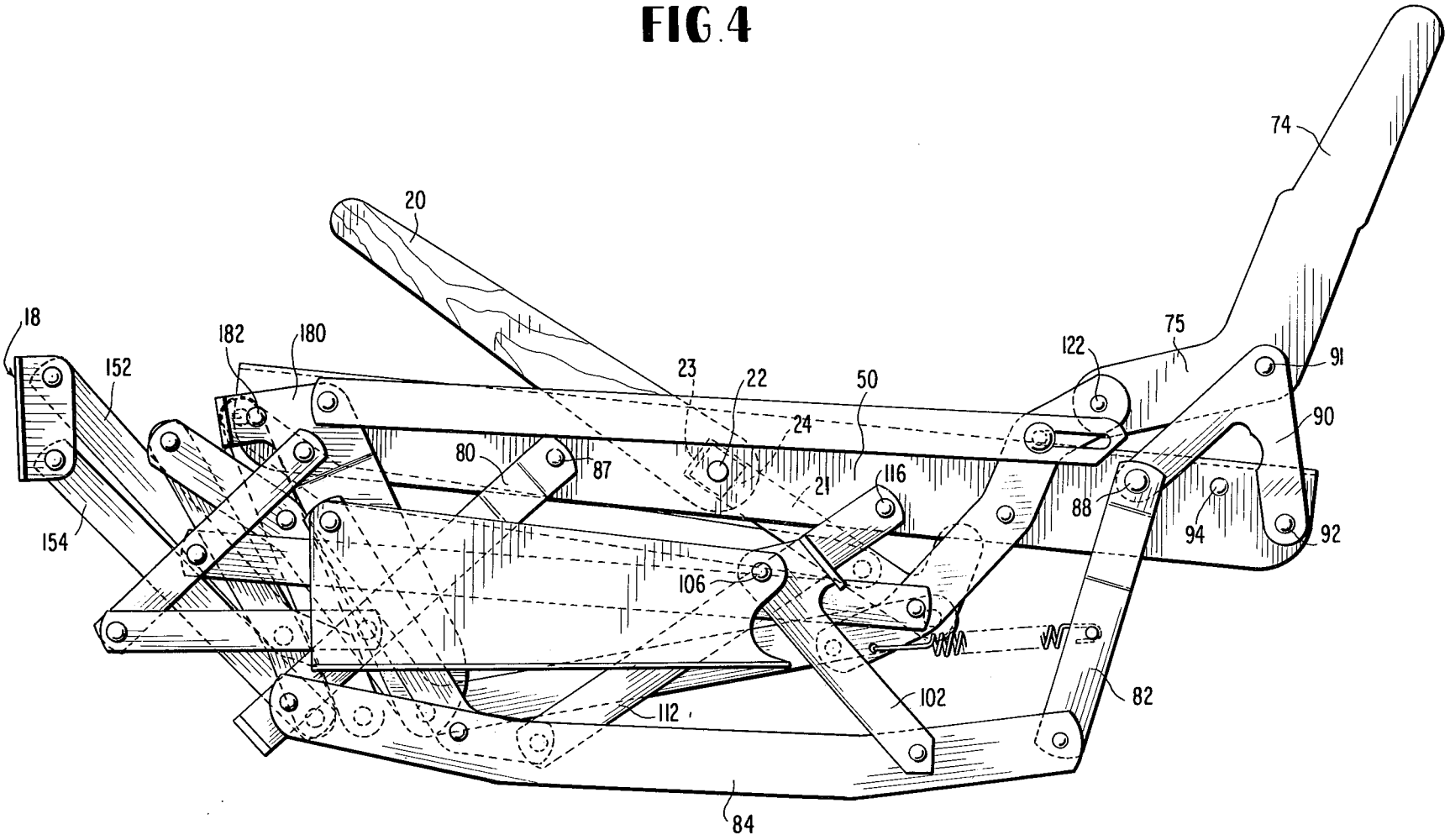
FIG. 4 is a view of the linkage system of FIG. 3 but as seen from the opposite side (inside) of the chair.

The footrest linkage is controlled by handle 20 and serves to move the footrest 18 between a closed or retracted position wherein the footrest 18 extends vertically below the front end of the chair, and an open or extended position wherein the footrest extends in a horizontal elevated plane. The retracted position of the footrest linkage is shown in FIGS. 3 and 4 while the extended position is shown in FIGS. 6 and 7. In moving between such positions, the footrest 18 pivots approximately 90° between vertical and horizontal planes.

In the specific embodiment shown, the footrest linkage includes a mounting bracket link 150 having a typical L-shaped cross section permitting one side of the footrest frame to be secured thereto. Bracket link 150 is connected by a pantograph or lazy tong-type linkage including two sets of generally parallelogram linkages, to a pair of extension links 170 and 172 which are adapted to be extended forwardly and rearwardly of the chair by the manual control handle 20.

In the specific embodiment, the lazy tong linkage includes: a first pair of generally parallel links 152 and 154 having their outer ends pivotally connected to bracket link 150 by pins 156 and 158; and a second pair of generally parallel links 160 and 162 having their ends pivotally connected by pins 168 and 169 to the inner ends of the first pair of parallel links 154 and 152. Link 160 is also pivotally connected by pin 164 intermediate its ends to an intermediate portion of link 152.

Upper extension link 170 has its forward end at pivot 174 pivotally connected to link 162 while lower extension link 172 which has an upwardly extending forward portion **172*a*, is pivoted at its forward end by pin 176 to link 160. Link 162 is also pivotally connected at an intermediate portion by pin 178, to an intermediate portion of forward portion 172*a* of extension link 172**.

In order to mount and control the position of the footrest linkage relative to the chair, a footrest mounting link in the form of a crank 180 is pivotally mounted at its upper end by pin 182 to the forward end portion of seat link 50. The lower end of crank 180 is pivotally connected by pin 184 to lower extension link 172 at the location where forward portion **172*a* of the lower extension link begins to rise. It will thus be seen that the vertical movement of extension link 172 is constrained within limits by crank 180, while the vertical motion of upper extension link 170 is similarly constrained by virtue of its connection to link 162 which, in turn, is pivotally connected to lower extension link portion 172*a***.

Movement of the footrest extension links 170 and 172 to actuate the footrest between extended and retracted positions is achieved by manual control handle 20 pivotally mounted at its lower end to seat link 50 by means of a handle link 21 rigidly fixed to handle 20 as an extension thereof and pivotally mounted by pin 22 to seat link 50. Handle link 21 has an outwardly extending portion 23 fixed by fasteners such as screws (not shown) to a stub shaft 24 shown as rectangular which projects from the side of the chair and is fixed to the lower end of handle 20. Stub shaft 24 is made of sufficient length to locate handle 20 outwardly of the upholstery of the chair where it may be easily grasped by the occupant of the chair to pivot handle link 21 in either direction about pivot 22. The lower end of handle link 21 is pivotally connected by pin 25 to the rear end of lower extension link 172 while just above pivot 25, handle link 21 is also pivotally connected by pin 26 to the rear end of the other extension link 170.

It will thus be seen that pivoting handle link 21 about pivot 22 will cause extension links 170 and 172 to move relative to each other for operating the pantograph footrest linkage to pivot the footrest 18 between vertical and horizontal planes while at the same time, projecting or retracting the footrest by virtue of the translational movement imparted to the extension links. Movement is imparted to the footrest linkage located on the side of the chair opposite the side which has handle 20, by means of a conventional torque tube (not shown) which interconnects the footrest linkages.

In order to limit the projected position of the footrest, a stop 27 is fixed on handle link 21 between pivots 26 and 25 to engage the lower edge of upper extension link 170 as shown in FIG. 6.

In order to bias the footrest into both the extended and retracted positions, an overcenter spring bias is provided including a tension coil spring 28 having one end anchored to a pin **28*a* fixed to an intermediate location on upper extension link 170 and an opposite end anchored to a pin 28*b* fixed to a lower rearward extension 29 of handle link 21. Depending on which side of pivot 26 the spring 28 is located, spring 28 will bias the footrest mechanism in either direction. This is illustrated in FIG. 3 where spring 28 is above pivot 26 and biases the footrest to its retracted position; and FIG. 6 wherein spring 28 is below pivot 26** and biases the footrest to its extended position.

ACTUATING LINKAGE FOR SEAT LINKAGE SYSTEM

As illustrated in FIG. 1B, when the chair is moved to TV position, that is, when the footrest is fully extended, the seat 14 is projected forward with wall-avoiding action and also is placed into a recline position with the back of the seat at a more pronounced lower elevation than the front end of the seat. This is achieved by actuating the first seat linkage (links 50, 82, 84 and 80) from the position shown in FIG. 3 to the position shown in FIG. 6 where the front mounting link 80 is pivoted in a clockwise direction as viewed in FIG. 6. Such actuation of the first seat linkage is achieved through a pair of actuating links 190 and 191 connected between the front mounting link 80 of the first seat linkage and the crank 180 which is a main mounting link for the footrest linkage. Actuating link 190 is pivotally connected at its forward end by pin 192 to a lower intermediate portion of mounting link 80 while the other actuating link 191 is pivotally connected at its upper end by pin 193 to an upper portion of crank 180. Actuating links 190 and 191 are pivotally connected to each other at their ends by pin 194.

Figure 5:
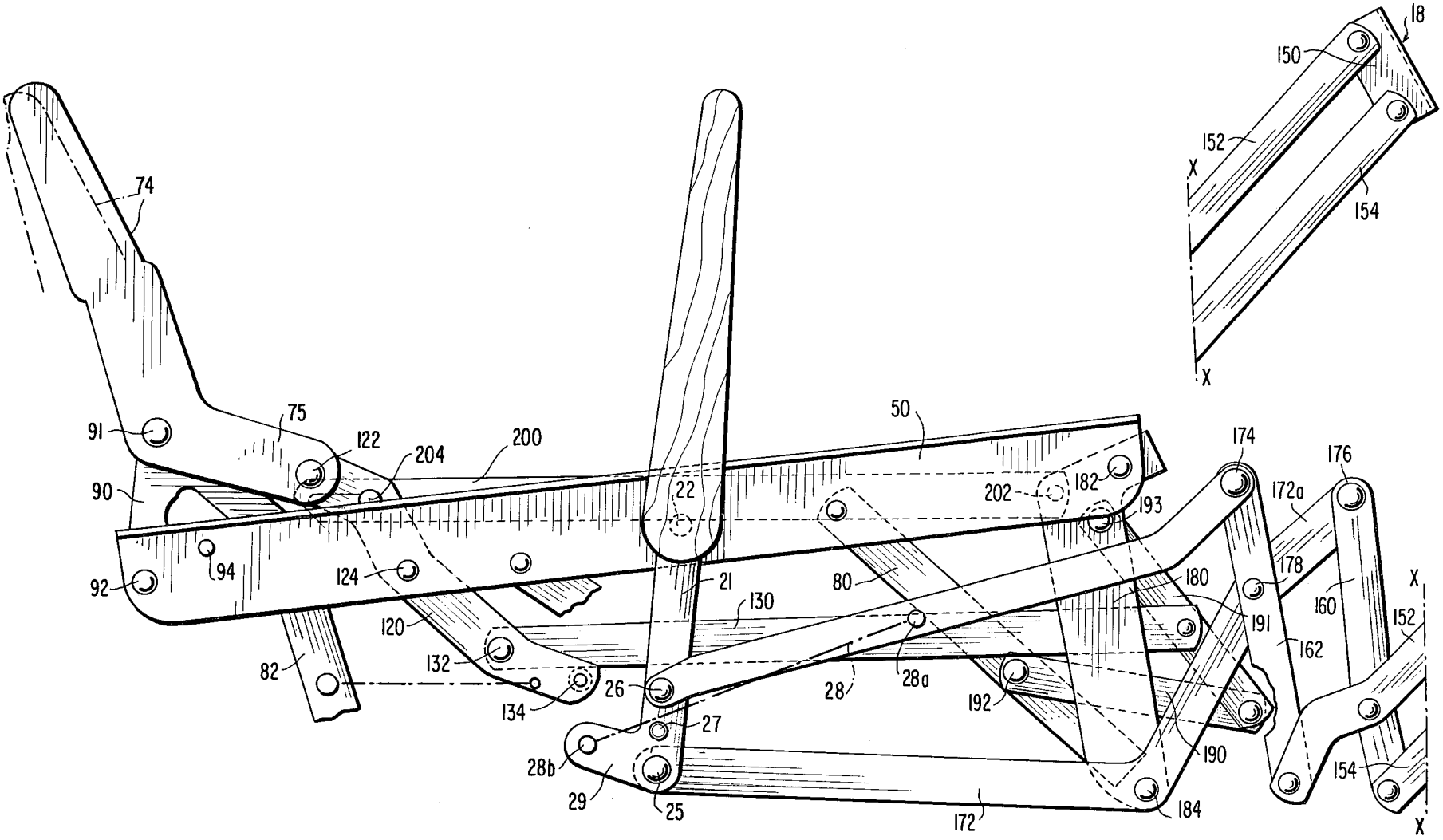
FIG. 5 is a side view of the linkage system similar to FIG. 3 but when the footrest has been partially moved out of retracted position towards fully extended position.

In operation, when the footrest control handle is moved from the closed position shown in FIG. 3 (where the footrest is retracted) to the position shown in FIG. 5 where the footrest is partially extended in the process of being fully extended, movement of the crank 180 of the footrest actuating linkage will cause movement of actuating link 191 by virtue of its connection to crank 180. In addition, actuating link 190 will pivot counterclockwise relative to front mounting link 80 of the first seat linkage but at this point such movement of actuating link 190 will have no effect on mounting link 80. However, upon continued movement of the footrest to its fully extended position caused by continued movement of control handle 20 beyond the position shown in FIG. 5 towards the TV position shown in FIG. 6, the continued movement of crank 180 will be effective to transmit motion through actuating link 190 through actuating link 191 and ultimately to front mounting link 80 which will cause the latter to pivot clockwise as shown in FIG. 6 which will have the effect of moving the first seat linkage, including the seat into the TV position shown in FIG. 6 with wall-avoiding action. It should be noted, however, that when the linkage reaches the TV position shown in FIG. 6, the backrest 16 will have pivoted slightly rearwardly shown by the dotted line in FIG. 5. This is achieved by engagement of stop 134 on the backrest actuator link 120 with the lower edge of transmission link 130 to couple these links to move as a unit clockwise (as viewed in FIGS. 5 and 6) about link 124 under a force emanating from actuating link 191 and imposed on transmission link 130.

Upon movement from the TV position shown in FIG. 6 to any of the further reclined positions, including full recline position shown in FIG. 7, the first seat linkage continues to be actuated by actuator links 191 and 190 acting on front mounting link 80. However, in contrast to the first phase of movement from upright to TV position where the energy for actuating the first seat linkage was derived from the control handle 20 and footrest mounting crank 180, the energy in the present instance is derived from the pressure on the backrest exerted by the occupant which is transmitted to backrest actuator link 120 and then through transmission link 130 to actuator link 191 from where it is transmitted to front mounting link 80 by actuator link 190 to further open the first seat linkage having the effect of continuing rotation of front mounting link 80 from the position shown in FIG. 6 into the position shown in FIG. 7. As noted above, during this second phase of movement, actuator link 112 connected between the seat link 50 and the front mounting link 100 of the second seat linkage continues to cause the second seat linkage, including mounting links 100, 102 to pivot about their respective pivots 104 and 106 to the fixed mounting plate 52 in a counterclockwise direction shown in FIG. 7 to compound the wall-avoiding action. It will be noted that during the second phase of movement into advance reclining positions, the seat is not only projected forwardly in wall-avoiding action, but furthermore the seat is placed into a rearward incline position as shown in FIG. 1C. Further, during such movement, the backrest 16 pivots relative to the seat 14 during which time the backrest actuator link 120 pivots clockwise as shown in FIG. 7 about pivot 124 and the V-shaped backrest mounting link 90 pivots clockwise about pivot 92 until it engages stop 94 to limit and define the full recline position.

SEQUENCING LINK

As will be apparent from the above, all movable action of the chair commences with extension of the footrest by use of the control handle 20. In order to prevent reclining movement of the backrest when the footrest is in the retracted position, an elongated sequencing link 200 is provided between the crank 180 which is the main footrest mounting link and the backrest actuator link 120. The forward end of sequencing link 200 is pivoted by pin 202 to the crank 180 while the rear end of sequencing link 200 is provided with an elongated slot 205 which receives a pin 204 fixed on link 120. When the footrest is in the fully retracted position shown in FIG. 3, pin 204 engages in the front end of slot 205 to prevent the backrest link 74 from pivoting counterclockwise. When the footrest is moved to the TV position, the pivoting movement of crank 180 causes sequencing link 200 to move forwardly, thus providing a space between pin 204 and the front end of slot 205 of the sequencing link 200 and the backrest undergoes slight rearward pivoting movement as shown by the dotted lines in FIG. 5. In the TV position shown in FIG. 6, sequencing link has moved forwardly to place stop 204 at the rear end of slot 205, however, when the chair moves to full recline position shown in FIG. 7, stop 204 returns to the front end of slot 205. While in the full recline position shown in FIG. 7, should the occupant return the footrest from extended to retracted position, crank 180 will exert a rearward force on stop 204 causing link 120 to pivot counterclockwise (as viewed in FIG. 7) about pivot 124 causing backrest link 74 and backrest to move to upright position.

SUMMARY OF LINKAGE SYSTEMS

By way of summary, the first and second seat linkages 50, 80, 82, 84 and 52, 100, 102, 84, respectively, may be defined as a "first linkage means" mounting the seat to the base. The backrest linkage including links 74, 75 and 90 may be defined as a "second linkage means". The footrest linkage including links 170, 172, 180, 160, 162, etc., may be defined as a "third linkage means". Links 190, 191 for actuating the first seat linkage in response to movement of the footrest linkage may be defined as a "fourth linkage means". Links 120 and 130 interconnected between the backrest linkage and the seat linkages for moving the latter in response to movement of the backrest to reclining position, may be termed a "fifth linkage means". Transmission link 200 interconnecting the footrest linkage and the backrest linkage may be termed a "sixth linkage means".

In addition to the control handle 20 and link 21 which may be termed a "first actuating means" for actuating the footrest; the linkage systems of the present invention summarized above incorporate additional actuating means for driving the seat with wall-avoiding action, first in response to movement of the footrest and subsequently, in response to movement of the backrest. Thus, in terms of actuating means, links 190, 191 may be termed a "second actuating means"; and links 120, 130, the first seat linkage and link 112 may be termed a "third actuating means".

SUMMARY OF OPERATION

Starting with chair and linkage in upright position of FIGS. 1A and 3, to extend the footrest, the control handle 20 is grasped and pivoted rearwardly to project footrest extension links 170, 172 forwardly and this causes lower extension link 172 to pivot crank 180 counterclockwise (as viewed in FIG. 5). During initial movement of crank 180, actuating link 191 is caused to move downwardly to push the forward end of transmission link 130 downwardly, and because link 130 is engaged with link 120 through the stop 134, these links pivot as a unit clockwise about pivot 124 to cause a slight rearward pivoting of backrest 16, 74 into the dotted line position shown in FIG. 5. During initial movement of crank 180 as the footrest is being moved to the TV position the sequencing link 200 will move forwardly to provide space between stop 204 and front end of slot 205 permitting the slight rearward recline of backrest just described. Because of the occupant's weight, this slight recline movement of the backrest, which is desired, must be forced through actuator link 191 as mentioned, it being understood that continued reclining movement of the backrest while the chair is moving to TV will be prevented by the occupant's weight on the seat which is greater than the occupant's pressure on the backrest.

During movement to TV position, the opposite or forward movement of the backrest is prevented by engagement of stop 134 with link 130. Furthermore, during such initial movement of crank 180, actuating link 190 will also be moved but relative to front mounting link 80 until it reaches a position shown in FIG. 5 after which continued movement of crank 180 forwardly as the footrest is moving to fully extended position causes actuating link 190 to push against mounting link 80 to begin to open the first seat linkage 50, 80, 82 and 84 which simultaneously opens the second seat linkage 52, 100, 102 and 84 by means of actuating link 112. This causes the seat to move forwardly relative to the base in wall-avoiding action, it being understood that the backrest being mounted to the seat linkage will move forwardly with the seat.

Continued movement of the control handle beyond the position shown in FIG. 5 to the position shown in FIG. 6 will project the footrest into fully extended TV position which is positively defined by engagement of stop 27 on link 21 against the lower edge of upper footrest extension link 170.

In the TV position, it will be noted that stop 204 is positioned in the rear of slot 205 of the sequencing link 200. Also, it will be noted from FIG. 1B that the reclining angle of the seat has increased, that is the front of the seat has been elevated and the rear of the seat has been lowered.

If it is desired to return the chair from TV position (FIGS. 1B and 6) to upright position (FIGS. 1A and 3), the occupant merely actuates the handle 20 in the opposite direction or, instead, applies rearward and downward foot pressure on the footrest which will cause the above sequence of linkage movements to be reversed.

If, on the other hand, it is desired to move from the TV position to any advanced reclining positions or the full recline position shown in FIGS. 1C and 7, back pressure is exerted on the backrest 16 causing link 120 and inverted V-link 90 to move in clockwise direction, as viewed in FIG. 7. Link 120 transmits through transmission link 130 a force to link 190 causing it to rotate relative to crank 180 clockwise to actuate front mounting link 80 through link 191. This causes the first seat linkage 50, 80, 82, 84 to open further whereby the seat and backrest are projected forwardly in wall-avoiding action. This is illustrated in FIG. 7 wherein the dotted lines indicate the linkage in TV position and the solid lines indicate the linkage in full recline position.

Movement of the backrest to full recline position is limited by stop 94 on seat mounting link 50 when it engages link 90 as shown in FIG. 7. During movement of the chair from TV position to full recline, the footrest linkage stays extended with no articulation (the footrest linkage was stopped when stop 27 engaged link 170), however, the footrest is further elevated when the chair is moved to full recline position since the front end of the seat is elevated and the rear end of the seat is lowered in full recline as shown in FIG. 1C. This provides an extremely comfortable full recline position. Theoretically, the chair may be moved to an infinite number of reclining positions between TV and full recline positions depending on the distribution of the occupant's weight.

To return the backrest to TV position from full recline, the occupant merely removes back pressure from the backrest 16 whereby his redistributed weight will allow a reverse movement to be imparted to the seat linkages to return to the TV position.

It should be noted that in the fully reclined position, stop 204 has returned to the front end of slot 205 in the sequencing link. Thus, if it is desired to return the seat towards TV or upright position, without removing back pressure from the backrest as described above, this may be effected by operating the control handle 20 to return the footrest to closed or retracted position. This will cause the sequencing link 200 to move rearwardly to force stop 205 to pivot link 120 counterclockwise (as viewed in FIG. 7) about pivot 124 to cause the backrest to pivot clockwise towards TV or upright position. The same result will be achieved if an accidental force is applied to the footrest while in the extended position to cause it to retract and, in turn, causing the backrest to move to upright position. Thus, a safety feature is provided for otherwise it could tip the chair over forwardly or break the linkage. It should be understood that the normal way of returning the backrest to upright position is by removing back pressure on the backrest and manipulation of handle 20 as described above.

To aid the closing movement of the seat linkages to assist return of the chair from TV to upright position, a coil tension spring may be employed if desired, for example, spring 225 connected between links 82 and 120 as shown in FIG. 3. When the chair is moved to TV from upright position, spring 225 will be tensioned and therefore will exert a biasing force tending to return the linkage to upright position. However, it is noted that spring 225 is not essential to operation of the seat linkage.

What is claimed is:

1. A wall-avoiding chair comprising in combination, a base, a seat, first linkage means mounting the seat relative to the base for movement between normal and reclining positions, a backrest, second linkage means mounting the backrest relative to the seat for movement relative to the seat between a generally upright position and a reclining position where the backrest extends at an incline relative to the seat, a footrest, third linkage means mounting the footrest for movement between a retracted position adjacent the seat and an extended position projected forwardly from the seat, a control handle connected to the third linkage means for moving the same between extended and retracted positions thereof, fourth linkage means connected between said first and third linkage means for moving the seat forwardly with wall-avoiding action relative to the base in response to movement of the footrest to extended position.

2. The wall-avoiding defined in claim 1 further including fifth linkage means operatively connected between said second linkage means and said first linkage means for moving said seat forwardly relative to the base when the backrest is moved into a reclining position.

3. The wall-avoiding chair defined in claim 2 wherein said fifth linkage means is connected to said first linkage means through said fourth linkage means.

4. The wall-avoiding chair defined in claim 3 further including a sixth linkage means interconnecting said second linkage means and said third linkage means for preventing reclining movement of said backrest when the footrest is in retracted position and for moving the backrest from a fully reclined position to upright position by operation of said control handle.

5. The wall-avoiding chair defined in claim 1 wherein said first linkage includes first and second closed seat linkages and actuating means interconnecting said seat linkages such that the first seat linkage activates the second seat linkage when the chair is moved into a reclining position.

6. The wall-avoiding chair defined in claim 5 wherein said first seat linkage includes the seat as part thereof, and said second seat linkage mounts said first seat linkage relative to the base.

7. The wall-avoiding chair defined in claim 6 wherein said first and second seat linkages include a common, carrier link.

8. The wall-avoiding chair defined in claim 7 wherein said first seat linkage includes a pair of mounting links interconnected by said carrier link, and wherein said second seat linkage includes a pair of mounting links pivotally mounted to the base at one end and said carrier link at the other end.

9. The wall-avoiding chair defined in claim 5 wherein said fourth linkage means is connected to said first seat linkage to actuate the same.

10. The wall-avoiding chair defined in claim 8 wherein said fourth linkage means is connected to said first seat linkage to actuate the same.

11. The wall-avoiding chair defined in claim 10 wherein said fourth linkage means is connected to one of said mounting links of the first seat linkage to actuate the same.

12. The wall-avoiding chair defined in claim 11 wherein said actuating means interconnecting said first and second seat linkages is an actuator link having one end operatively connected to one of the mounting links of the second seat linkage and having an opposite end pivotally connected to one of the links of the first seat linkage to actuate the said one mounting link of the second seat linkage when the first seat linkage is actuated to project the seat forwardly with wall-avoiding action.

13. The wall-avoiding chair defined in claim 12 wherein said third linkage means includes a mounting link pivotally mounted at one end portion thereof to said seat and wherein said fourth linkage means is pivotally connected to said mounting link of said third linkage means to be actuated thereby when the footrest is moved towards extended position.

14. The wall-avoiding chair defined in claim 13 wherein said fourth linkage means includes a first link pivotally connected to said mounting link of said third linkage means, and a second link pivotally connected to said one of the mounting links of said first closed seat linkage, said first and second links of said fourth linkage means being pivotally interconnected to each other.

15. The wall-avoiding chair defined in claim 14 further including fifth linkage means connected between said second linkage means and said fourth linkage means for moving said seat forwardly with wall-avoiding action when the chair is moved to reclining position.

16. The wall-avoiding chair defined in claim 15 wherein said fifth linkage means is connected to said one link of said fourth linkage means.

17. The wall-avoiding chair defined in claim 16 wherein said second linkage means includes a backrest mounting link pivotally connected to said backrest and pivotally mounted to said seat and further being pivotally connected to the other mounting link of said first seat linkage and wherein said second linkage means further includes an actuator link having one end portion pivotally connected to said backrest and being pivotally mounted intermediate its ends to the seat, said last defined actuator link being pivotally connected to said fifth linkage means to drive the same when the backrest is moved into further reclined positions while the footrest is in extended position.

18. The wall-avoiding chair defined in claim 14 wherein said second linkage means includes an actuator link pivotally connected to the backrest and being pivotally mounted intermediate its ends to the seat, said actuator link of said second linkage means being pivotally connected to said fifth linkage means to drive the same when the backrest is moved into further reclined positions while the footrest is in extended position.

19. The wall-avoiding chair defined in claim 17 further including a sequencing link pivotally connected between said mounting link of said third linkage means and said actuator link of said second linkage means to prevent reclining movement of said backrest when the footrest is in retracted position and for moving said backrest from full reclining position to upright position by operation of said control handle.

20. The wall-avoiding chair defined in claim 19 wherein said sequencing link has an elongated slot adjacent one end thereof and said actuator link of said second linkage has a pivot means received in said slot to interconnect said sequencing link and said actuator link of said second linkage means.

21. The wall-avoiding chair defined in claim 17 further including stop means on said seat engageable by said backrest mounting link when the backrest is moved to an advanced recline position to thereby determine the full recline position of the backrest.

22. A linkage system for a wall-avoiding chair of the type including a base, a seat movably mounted on the base for wall-avoiding movement, a backrest connected to the seat and movable relative to the seat between generally upright and reclined positions by the occupant exerting back pressure on the backrest, a footrest movable between a retracted position adjacent the seat and an extended position projected forwardly of the seat; the linkage system comprising in combination, a seat linkage system for mounting the seat relative to the base, a footrest linkage connected at one end to the seat linkage system for extending and retracting the footrest, first actuating means for actuating the footrest linkage to move the footrest between extended and retracted positions, second actuating means including a linkage connected between the seat linkage system and the footrest for initially moving the seat linkage system forwardly relative to the base in wall-avoiding action when the footrest is moved to extended position, and third actuating means including a linkage connected between the seat linkage system and the backrest for further moving the seat linkage system forwardly relative to the base in wall-avoiding action following the initial movement and when the backrest is moved to a reclined position.

23. The linkage system defined in claim 22 further including a sequencing linkage connected between the footrest linkage and said third actuating means for preventing reclining movement of the backrest when the footrest is in retracted position.

24. The linkage system defined in claim 23 further including backrest mounting linkage pivotally mounted on the seat linkage and adapted to be pivotally connected to the backrest to mount the backrest relative to said seat linkage system; said third actuating means being connected to the backrest mounting linkage.

25. The linkage system defined in claim 22 wherein said seat linkage system includes first and second seat linkages, the first seat linkage including a seat link adapted to be fixed to the seat of the associated chair, a carrier link, and links mounting the seat link to the carrier link, the second seat linkage including said carrier link, and links pivotally connected to the carrier link and adapted to be pivotally connected to the base of the associated chair, and wherein said third actuating means includes said first seat linkage and a link interconnecting said first and second seat linkages such that the first seat linkage will actuate the second seat linkage to move the seat linkage system forwardly relative to the base of the associated chair in wall-avoiding action when the backrest is moved to reclined position.

26. The linkage system defined in claim 25 wherein the first actuating means includes two links pivotally connected to each other with one link being pivotally connected to the first seat linkage and the other link pivotally connected to the footrest linkage.

27. The linkage system defined in claim 26 wherein said third actuating means further includes a transmission link pivotally connected to said second actuating means and a link pivotally connected to the transmission link and adapted to be connected to the backrest of the associated chair such that movement of the backrest to a reclined position will be transmitted through said last two defined links to said first actuating means and then to said first seat linkage and then to said second seat linkage driving the same forwardly relative to the base.

28. A wall-avoiding chair comprising in combination, a base, a seat including rigid armrests, a first linkage means mounting said seat on the base for wall-avoiding movement, a backrest, second linkage means mounting the backrest relative to the seat for movement between generally upright and reclining positions, a footrest, third linkage means mounting the footrest relative to the seat for movement between extended and retracted positions, first actuating means for actuating said third linkage means to move the footrest between said extended and retracted positions thereof, second actuating means connected to said third linkage means for moving said first linkage means to impart initial wall-avoiding movement to the seat when the footrest is moved from retracted to extended position, and third actuating means including linkage connected to the backrest and to said first linkage means for imparting further wall avoiding movement to the seat following the initial movement and when the backrest is moved into a reclining position relative to the seat.

29. The wall avoiding chair defined in claim 28 wherein said first actuating means includes a manual handle mounted relative to the seat.

* * * * *